US011796945B2

(12) United States Patent
Watatani et al.

(10) Patent No.: US 11,796,945 B2
(45) Date of Patent: Oct. 24, 2023

(54) FIXING DEVICE AND IMAGE FORMING APPARATUS

(71) Applicant: KYOCERA Document Solutions Inc., Osaka (JP)

(72) Inventors: Tomohiro Watatani, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/049,950

(22) Filed: Oct. 26, 2022

(65) Prior Publication Data

US 2023/0130258 A1 Apr. 27, 2023

(30) Foreign Application Priority Data

Oct. 27, 2021 (JP) ..... 2021-175749
Sep. 8, 2022 (JP) ..... 2022-142806

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2064; G03G 2215/2003; G03G 2215/2019; G03G 2215/2022; G03G 2215/2035; G03G 2215/2038
See application file for complete search history.

(56) References Cited

U.S. PATENT DOCUMENTS

2020/0103796 A1* 4/2020 Furuichi ..... G03G 15/2053
2020/0387096 A1* 12/2020 Adachi ..... G03G 15/80
2021/0157259 A1* 5/2021 Inoue ..... H05B 3/03

FOREIGN PATENT DOCUMENTS

JP 2006-163297 A 6/2006

* cited by examiner

*Primary Examiner* — Hoang X Ngo
(74) *Attorney, Agent, or Firm* — Studebaker & Brackett PC

(57) ABSTRACT

A fixing device includes a fixing belt, a pressing roller, a flat heater, a heater holder and a pair of mounting members. The flat heater has a first surface coming into contact with an inner circumferential surface of the fixing belt and a second surface opposite to the first surface. The heater holder comes into contact with the second surface of the flat heater. The mounting members comes into contact with both end portions of the first surface of the flat heater in the width direction, and are mounted to the heater holder such that the flat heater is held between the mounting members and the heater holder. The mounting member includes a downstream side end surface contact part which comes into contact with a downstream side end surface of the flat heater in the conveying direction.

10 Claims, 17 Drawing Sheets

FIXING DEVICE AND IMAGE FORMING APPARATUS

INCORPORATION BY REFERENCE

This application is based on and claims the benefit of priorities from Japanese patent application Nos. 2021-175749 filed on Oct. 27, 2021 and 2022-142806 filed on Sep. 8, 2022, which are incorporated by reference in their entirety.

BACKGROUND

The present disclosure relates to a fixing device which fixes a toner image on a sheet and an image forming apparatus including the fixing device.

A fixing device which heats a fixing belt using a flat heater is known. Since the flat heater has a thin plate shape, its rigidity is low by itself. Therefore, the flat heater is held by a heater holder having high rigidity. The heater holder is provided with a recess having a depth corresponding to the thickness of the flat heater, and the flat heater is housed in the recess.

In consideration of the dimensional error of the flat heater and the warpage of the heater holder, the length of the recess of the heater holder in the sheet conveying direction is designed to be larger than that of the flat heater. Therefore, conventionally, the flat heater is adhered to the recess in order to prevent the deviation of the flat heater in the conveying direction. However, since the temperature of the flat heater when being energized reaches around 200° C., volatile organic compounds may be generated from the adhesive.

SUMMARY

In accordance with an aspect of the present disclosure, a fixing device includes a cylindrical fixing belt, a pressing roller, a flat heater, a heater holder and a pair of mounting members. The pressing roller holds a sheet between the pressing roller and the fixing belt and conveys the sheet. The flat heater has a length in a width direction crossing a conveying direction of the sheet longer than a length of the fixing belt, and has a first surface coming into contact with an inner circumferential surface of the fixing belt and a second surface opposite to the first surface. The heater holder comes into contact with the second surface of the flat heater and has a length in the width direction longer than a length of the fixing belt. The pair of mounting members come into contact with both end portions of the first surface of the flat heater in the width direction, and is mounted to the heater holder such that the flat heater is held between the mounting members and the heater holder. The pair of mounting members is provided with a downstream side end surface contact part which comes into contact with a downstream side end surface of the flat heater in the conveying direction.

In accordance with an aspect of the present disclosure, an image forming apparatus includes an image forming device which forms a toner image on the sheet, and the fixing device which fixes the toner image to the sheet.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
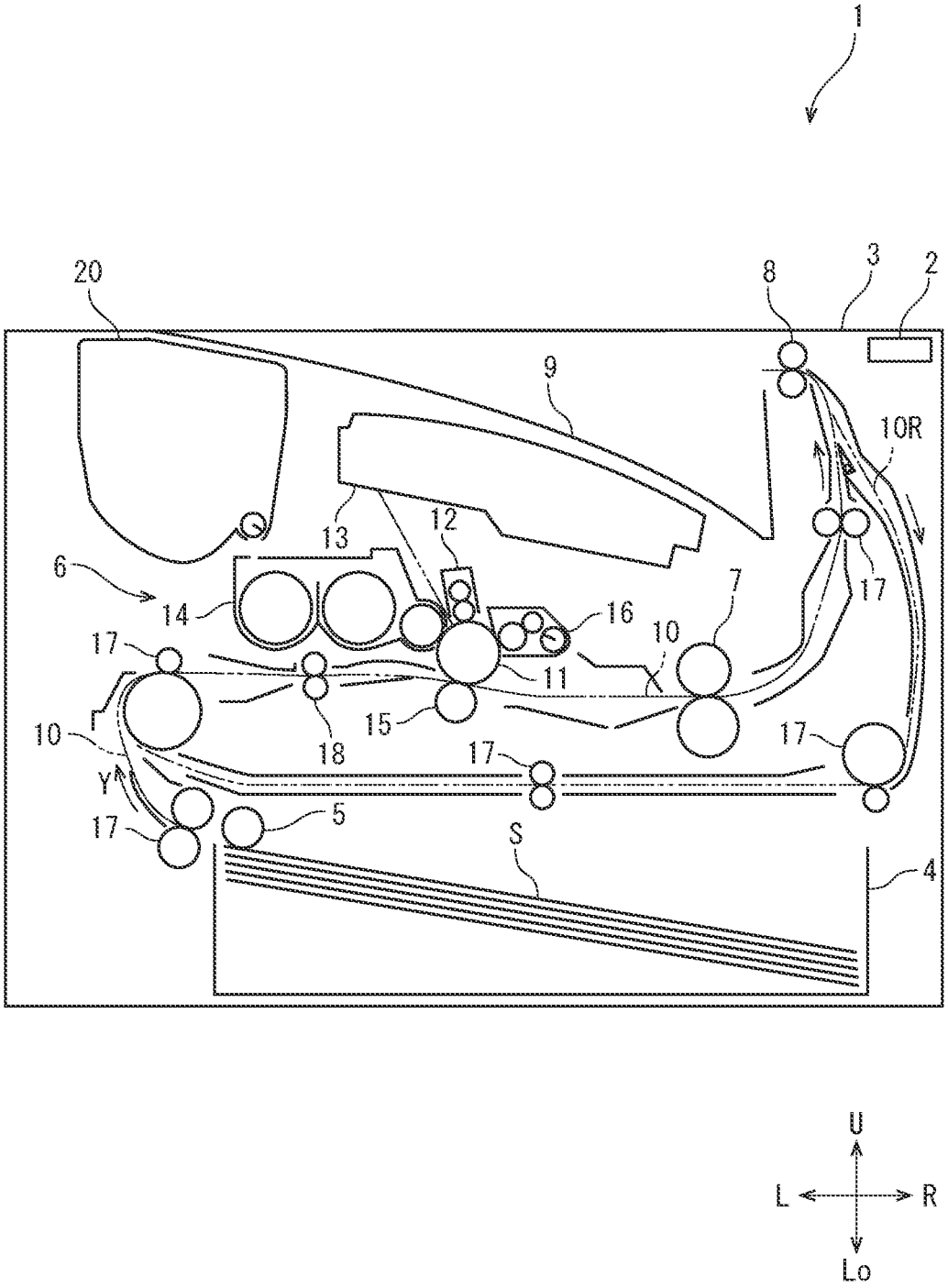
FIG. 1 is a front view schematically showing an inner structure of a printer according to one embodiment of the present disclosure.

First, the entire structure of a printer 1 (an example of the image forming apparatus) will be described. FIG. 1 is a front view schematically showing the internal structure of the printer 1. Hereinafter, the front side of the paper plane on which FIG. 1 is drawn is referred to as the front side of the printer 1, and the left-and-right direction will be described with reference to the direction in which the printer 1 is viewed from the front. In each drawing, U, Lo, L, R, Fr, and Rr indicate an upper, a lower, a left, a right, a front and a rear, respectively.

The printer 1 includes a rectangular parallelepiped main body housing 3. In the lower portion of the inside of the main body housing 3, a sheet feeding cassette 4 in which a sheet S is stored and a sheet feeding roller 5 which feeds the sheet S leftward from the sheet feeding cassette 4 are provided. Above the sheet feeding cassette 4, an image forming device 6 which forms a toner image by an electrophotographic method is provided, and a fixing device 7 which fixes the toner image to the sheet S is provided on the right side of the image forming device 6. Above the fixing device 7, a sheet discharging roller 8 which discharges the sheet S on which the toner image is fixed and a sheet discharge tray 9 on which the discharged sheet S is stacked are provided.

Inside the main body housing 3, a conveyance path 10 is provided from the sheet feeding roller 5 to the sheet discharging roller 8 via the image forming device 6 and the fixing device 7. The conveyance path 10 is formed using plate-like members facing each other with a gap for passing the sheet S therethrough, and a conveying roller 17 which holds and conveys the sheet S is provided at a plurality of positions in the conveying direction Y. A registration roller 18 is provided on the upstream side of the image forming device 6 in the conveying direction Y. A reverse conveyance path 10R branching from the conveyance path 10 on the downstream side of the fixing device 7 in the conveying direction Y and merging with the conveyance path 10 on the upstream side of the registration roller 18 in the conveying direction Y is provided on the right side of the fixing device 7.

The image forming device 6 is provided with a photosensitive drum 11 whose potential is changed by irradiation of light, a charging device 12 which charges the photosensitive drum 11, an exposure device 13 which emits laser light according to image data, a developing device 14 which supplies toner to the photosensitive drum 11, a transferring device 15 which transfers a toner image from the photosensitive drum 11 to the sheet S, and a cleaning device 16 which removes the toner remaining on the photosensitive drum 11. A toner container 20 which contains the toner supplied to the developing device 14 is connected to the developing device 14.

The controller 2 includes an arithmetic part and a storage part. The arithmetic part is a CPU (Central Processing Unit), for example. The storage part includes a storage medium such as ROM (Read Only Memory), RAM (Random Access Memory), EEPROM (Electrically Erasable Programmable Read Only Memory), and the like. The arithmetic part executes various processes by reading and executing the control program stored in the storage part. The controller 2 may be implemented by an integrated circuit without using software.

The basic image forming operation of the printer 1 is as follows. When a single-sided printing job is input to the printer 1 from an external computer or the like, the sheet feeding roller 5 feeds the sheet S from the sheet feeding cassette 4 to the conveyance path 10, the registration roller 18 whose rotation is stopped corrects the skew of the sheet S, and the registration roller 18 feeds the sheet S to the image forming device 6 at a predetermined timing. In the image forming device 6, the charging device 12 charges the photosensitive drum 11 to a predetermined potential, the exposure device 13 writes an electrostatic latent image on the photosensitive drum 11, the developing device 14 develops the electrostatic latent image using the toner supplied from the toner container 20 to form a toner image, and the transferring device 15 transfers the toner image to the sheet S. Subsequently, the toner image is fixed to the sheet S by melting the toner image while the fixing device 7 holds and conveys the sheet S, and the sheet discharging roller 8 discharges the sheet S to the sheet discharge tray 9. In the case of double-sided printing, the sheet S having the toner image fixed on the first surface is fed to the conveyance path 10 via the reverse conveyance path 10R, whereby the toner image is transferred to the second surface.

Figure 2:
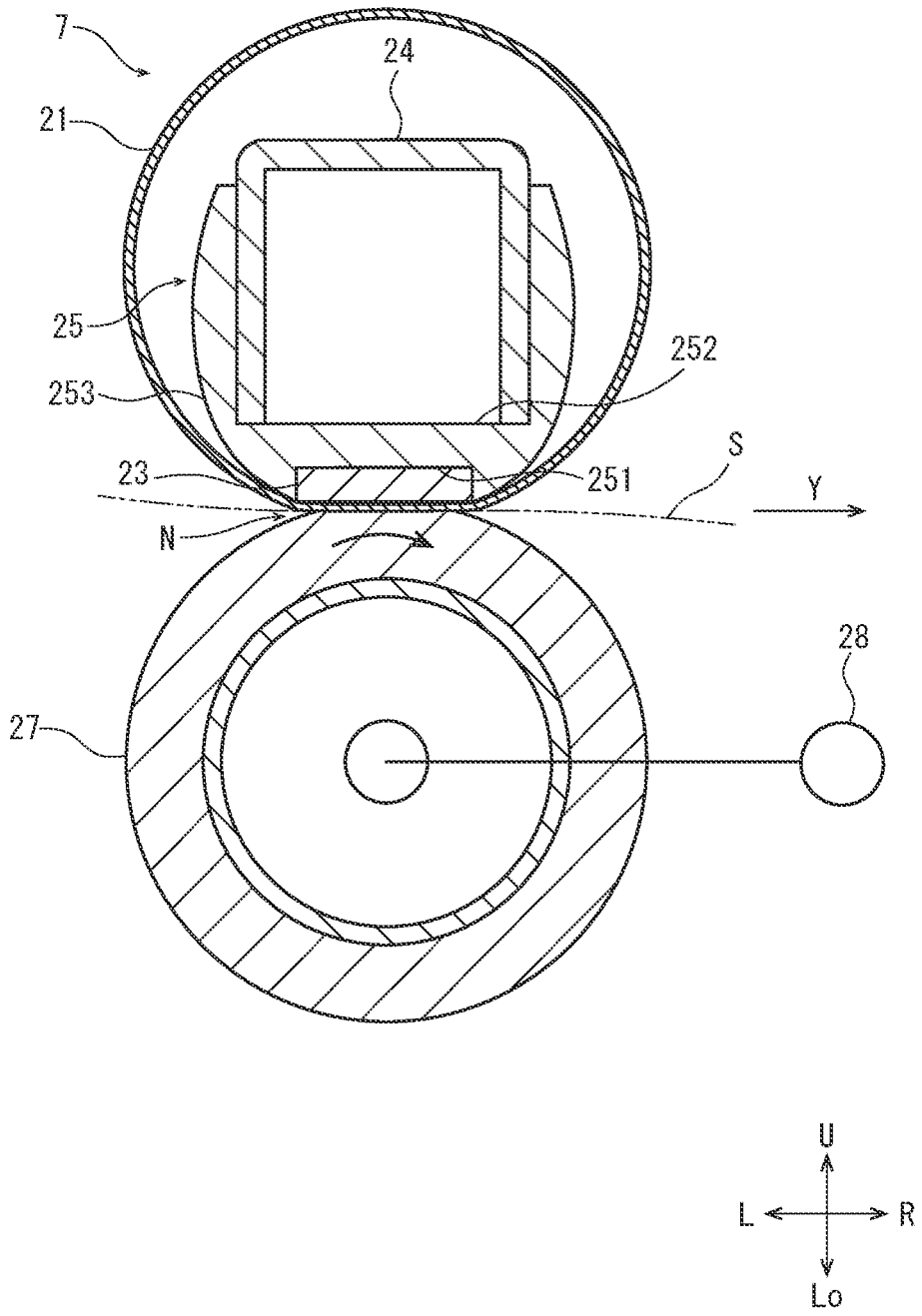
FIG. 2 is a sectional view showing a fixing device according to the embodiment of the present disclosure.
Figure 3:
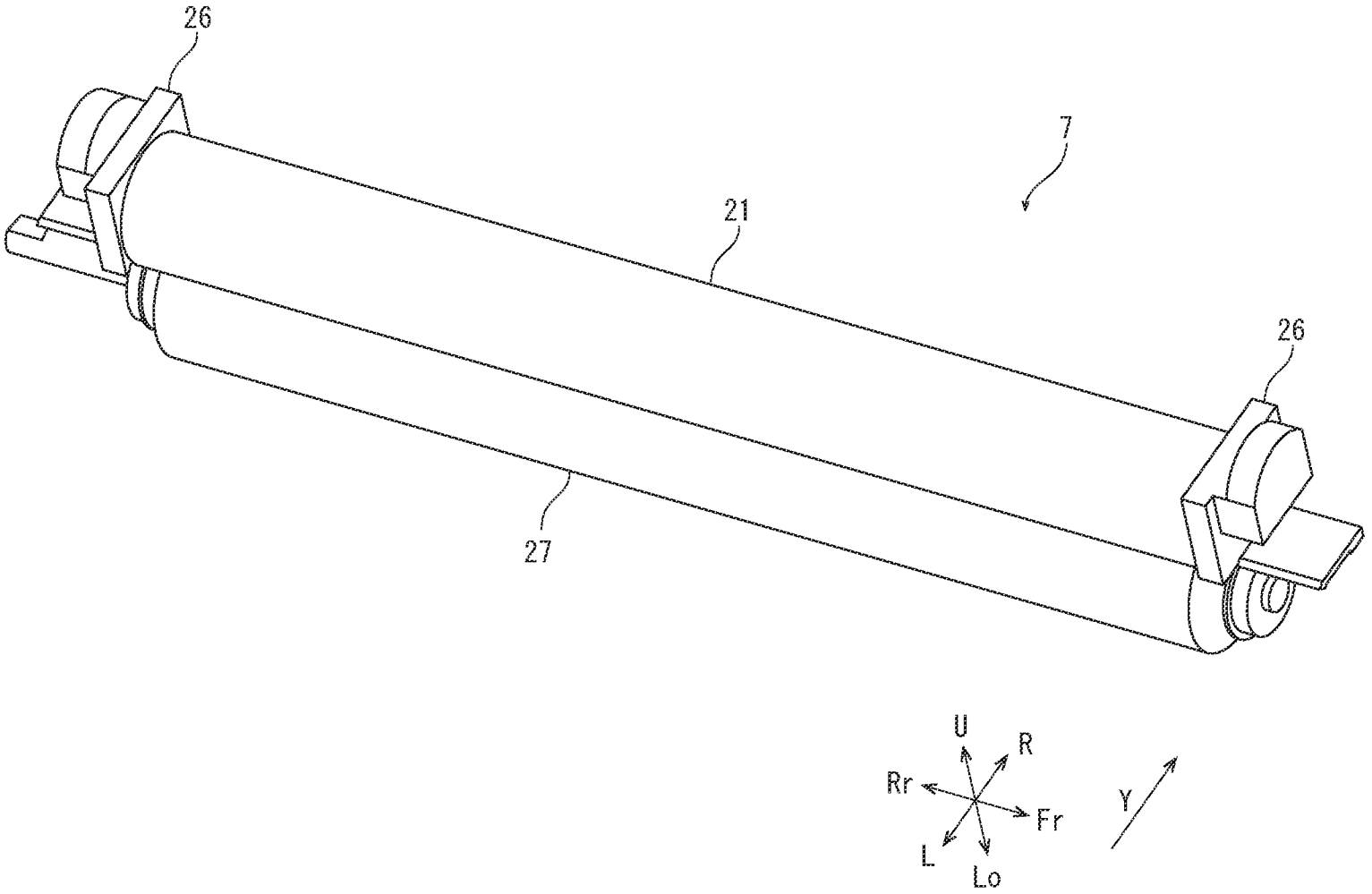
FIG. 3 is a perspective view showing the fixing device according to one embodiment of the present disclosure.
Figure 4:
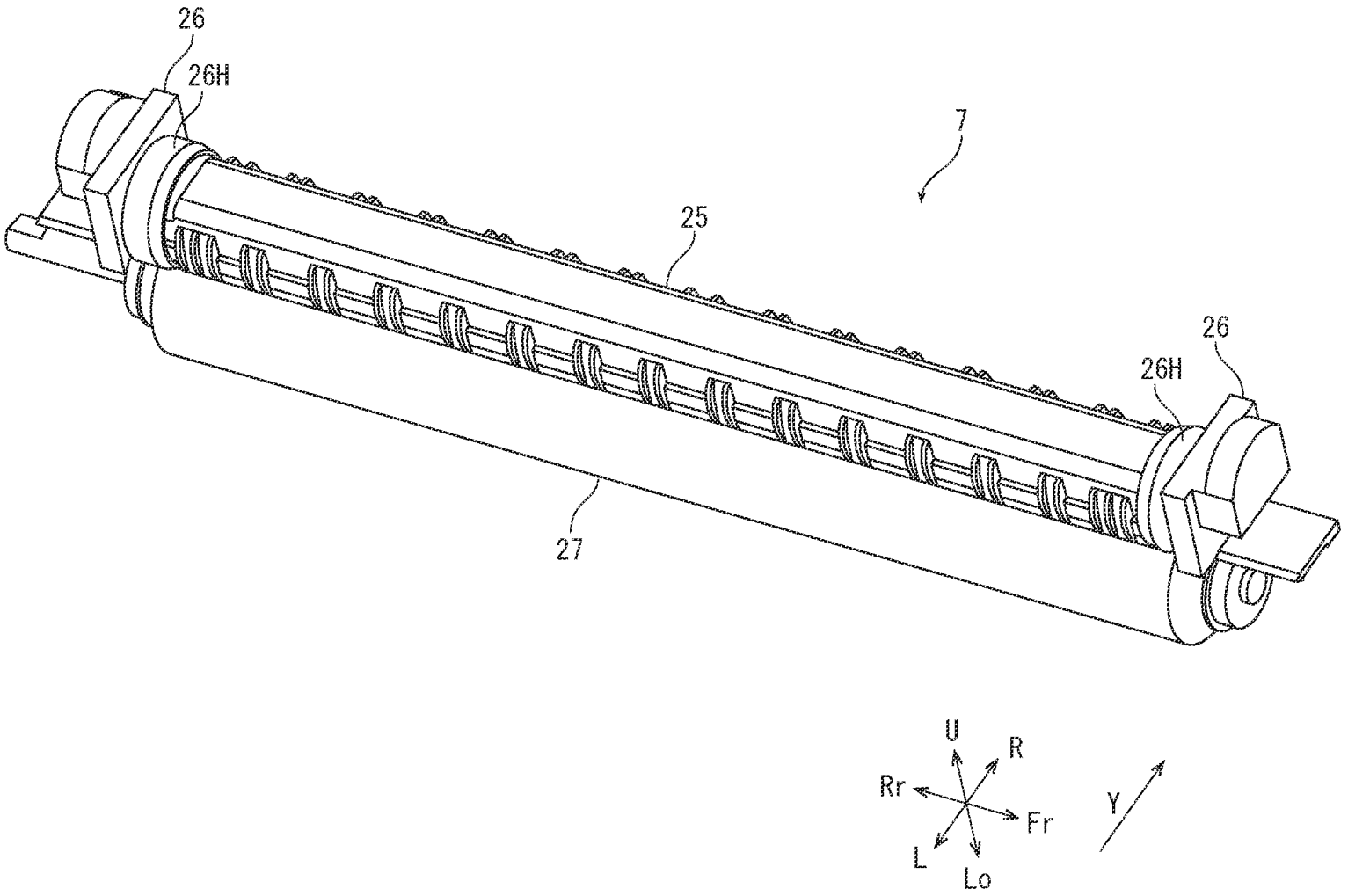
FIG. 4 is a perspective view showing the fixing device excluding a fixing belt according to the embodiment of the present disclosure.
Figure 5:
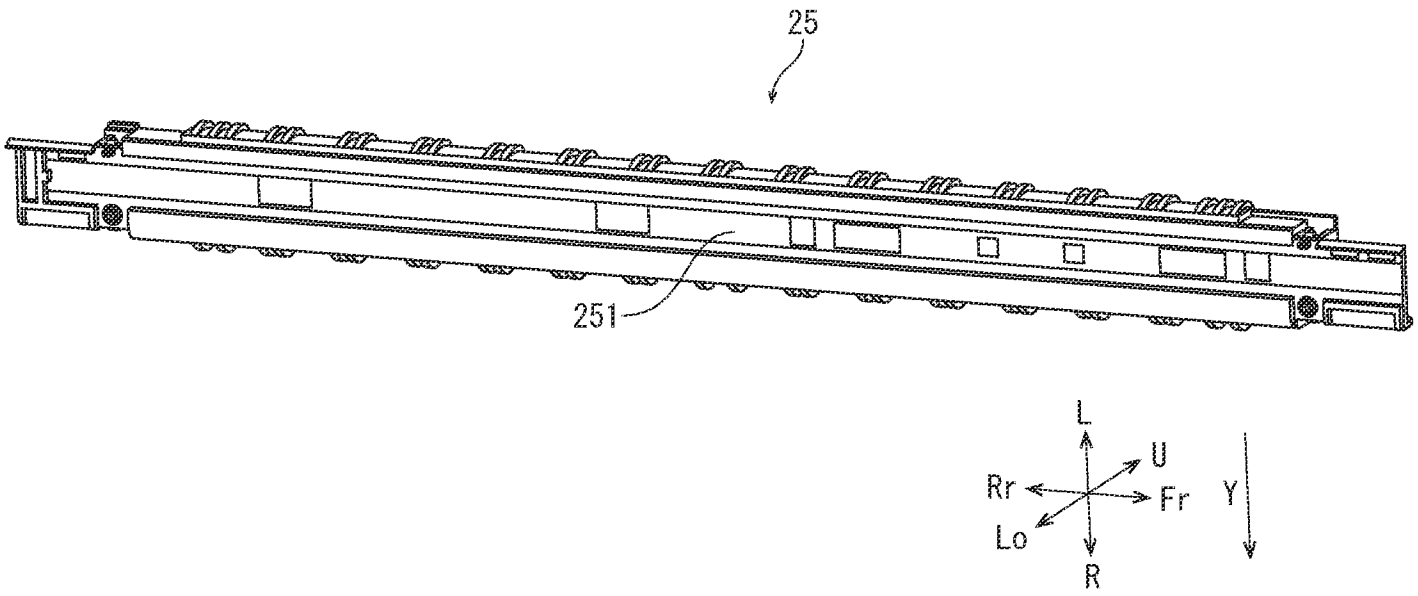
FIG. 5 is a perspective view showing a heater holder according to the embodiment of the present disclosure.

[Fixing Device] Next, the fixing device 7 will be described in detail. FIG. 2 is a sectional view showing the fixing device 7. FIG. 3 is a perspective view showing the fixing device 7. FIG. 4 is a perspective view showing the fixing device 7 excluding a fixing belt 21. FIG. 5 is a perspective view showing a heater holder 25.

The fixing device 7 includes a rotatable fixing belt 21, a flat heater 23, a heater holder 25, a supporting member 24, a pressing roller 27, and a driving part 28 such as a motor. The flat heater 23 comes into contact with the inner circumferential surface of the fixing belt 21, and heats the fixing belt 21. The heater holder 25 holds the flat heater 23. The pressing roller 27 holds the sheet S with the fixing belt 21 and conveys the sheet S. The driving part 28 drives the pressing roller 27. The fixing device 7 is housed in a fixing housing 8 not shown), and the fixing housing is fixedly attached to the main body housing 3. The present embodiment shows an example where the fixing device 7 is disposed in a posture in which the pressing roller 27 is disposed below the fixing belt 21, but the fixing device 7 may be disposed in any posture.

[Fixing Belt] The fixing belt 21 (see FIG. 2 and FIG. 3) is a cylindrical endless belt having a hollow part penetrating in the front-and-rear direction, and has a length in the front-and-rear direction longer than the width of the sheet S. The fixing belt 21 includes a base layer, an elastic layer provided on the outer circumferential surface of the base layer, and a release layer provided on the outer circumferential surface of the elastic layer (not shown), and has flexibility. The base layer is made of metal such as stainless steel or nickel alloy. The elastic layer is made of silicone rubber or the like. The release layer is made of a PFA (tetrafluoroethylene/perfluoroalkoxyethylene copolymer resin) tube or the like. A sliding layer may be formed on the inner circumferential surface of the base layer. The sliding layer is made of polyimide amide, PTFE (polytetrafluoroethylene), or the like.

[Flat Heater] The flat heater 23 (see FIG. 2) is formed in a substantially rectangular plate shape whose longitudinal direction is along the front-and-rear direction. The flat heater 23 includes a base material, a heat insulating layer, a heat generating layer and a coating layer. The base material is made of material having electrical insulating properties such as ceramics, and is formed in a substantially rectangular plate shape whose longitudinal direction is along the front-and-rear direction. The heat insulating layer is made of material having electrical insulating properties and low heat conductivity such as ceramics and glass, and is laminated on the lower surface of the base material. The heat insulating layer suppresses transmission of heat generated by the heat generating layer to the side of the base material. The heating layer is made of electric conductive material such as metal having a high resistance value, and is formed on the lower surface of the heat insulating layer. The coating layer is made of material having electrical insulation properties and small sliding friction resistance with respect to the fixing belt 21, such as ceramics. The coating layer covers the heating layer, and the lower surface of the coating layer comes into contact with the inner surface of the fixing belt 21.

[Heater Holder] The heater holder 25 (see FIG. 2 and FIG. 4) has a length equal to that of the flat heater 23 in the front-and-rear direction. The heater holder 25 is made of heat-resistant resin such as liquid crystal polymer. In the lower portion of the heater holder 25, a first recess part 251 opened downward and elongated in the front-and-rear direction is provided, and the flat heater 23 is housed in the first recess part 251. In the left and right side portions of the heater holder 25, curved surfaces 253 having a curvature larger than that of the fixing belt 21 are provided.

[Supporting Member] The supporting member 24 (see FIG. 2) whose longitudinal direction is along the front-and-rear direction penetrates through the hollow part of the fixing belt 21. The supporting member 24 is made of metal such as stainless steel or aluminum alloy. A cross section perpendicular to the front-and-rear direction of the supporting member 24 has a U-shape opened downward. A second recess part 252 opened upward and elongated in the front-and-rear direction is provided in the upper portion of the heater holder 25, and the supporting member 24 is fitted in the second recess part 252. The supporting member 24 supports the heater holder 25.

[End Belt Holder] End belt holders 26 (see FIG. 3 and FIG. 4) are provided in both the front and rear end portions of the supporting member 24. The end belt holders 26 are supported by the main body housing 3, and supports the supporting member 24. The end belt holder 26 has a cylindrical belt holding part 26H. The belt holding part 26H has an outer diameter corresponding to the inner diameter of the fixing belt 21, and the belt holding parts 26H are fitted to both the front and rear end portions of the fixing belt 21. The fixing belt 21 is rotatable along the belt holding parts 26H.

[Pressing Roller] The pressing roller 27 (see FIG. 2 to FIG. 4) includes a core metal, an elastic layer provided on the outer circumferential surface of the core metal and a release layer provided on the outer circumferential surface of the elastic layer (not shown). The core metal is made of metal such as stainless steel. The elastic layer is made of silicone rubber or the like. The release layer is made of PFA tube or the like. The pressing roller 27 is biased toward the fixing belt 21 by a biasing member (not shown) such as a spring. As a result, the fixing belt 21 is held between the pressing roller 27 and the flat heater 23, and a nip region N where the fixing belt 21 and the pressing roller 27 are brought into contact with each other is formed.

Next, the fixing operation of the fixing device 7 will be described. When the pressing roller 27 is driven to be rotated in a predetermined rotation direction, the fixing belt 21 is rotated following the rotation of the pressing roller 27, and the inner circumferential surface of the fixing belt 21 slides with respect to the flat heater 23. When electric power is supplied to the heating layer of the flat heater 23, the heating layer generates heat to heat the fixing belt 21. After the temperature of the fixing belt 21 reaches a predetermined temperature, the sheet S to which the toner has been transferred is conveyed to the nip region N. In the nip region N, the sheet S is held between the fixing belt 21 and the pressing roller 27 and conveyed. At this time, the toner is heated and pressurized by the fixing belt 21, and the toner is fixed to the sheet S. The sheet S to which the toner is fixed is separated from the fixing belt 21 and conveyed along the conveyance path 10.

Figure 6:
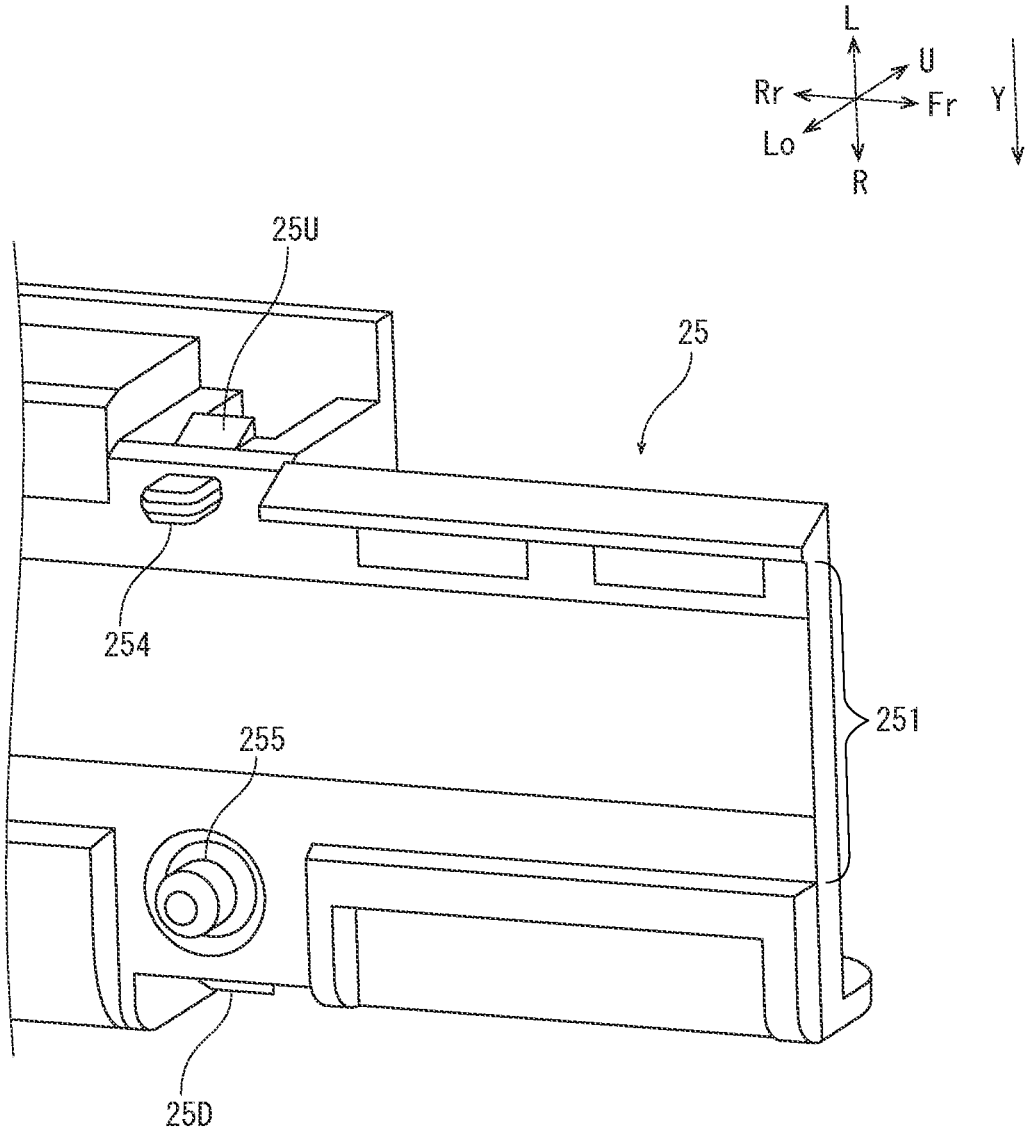
FIG. 6 is a perspective view showing a front end portion of the heater holder according to the embodiment of the present disclosure.
Figure 7:
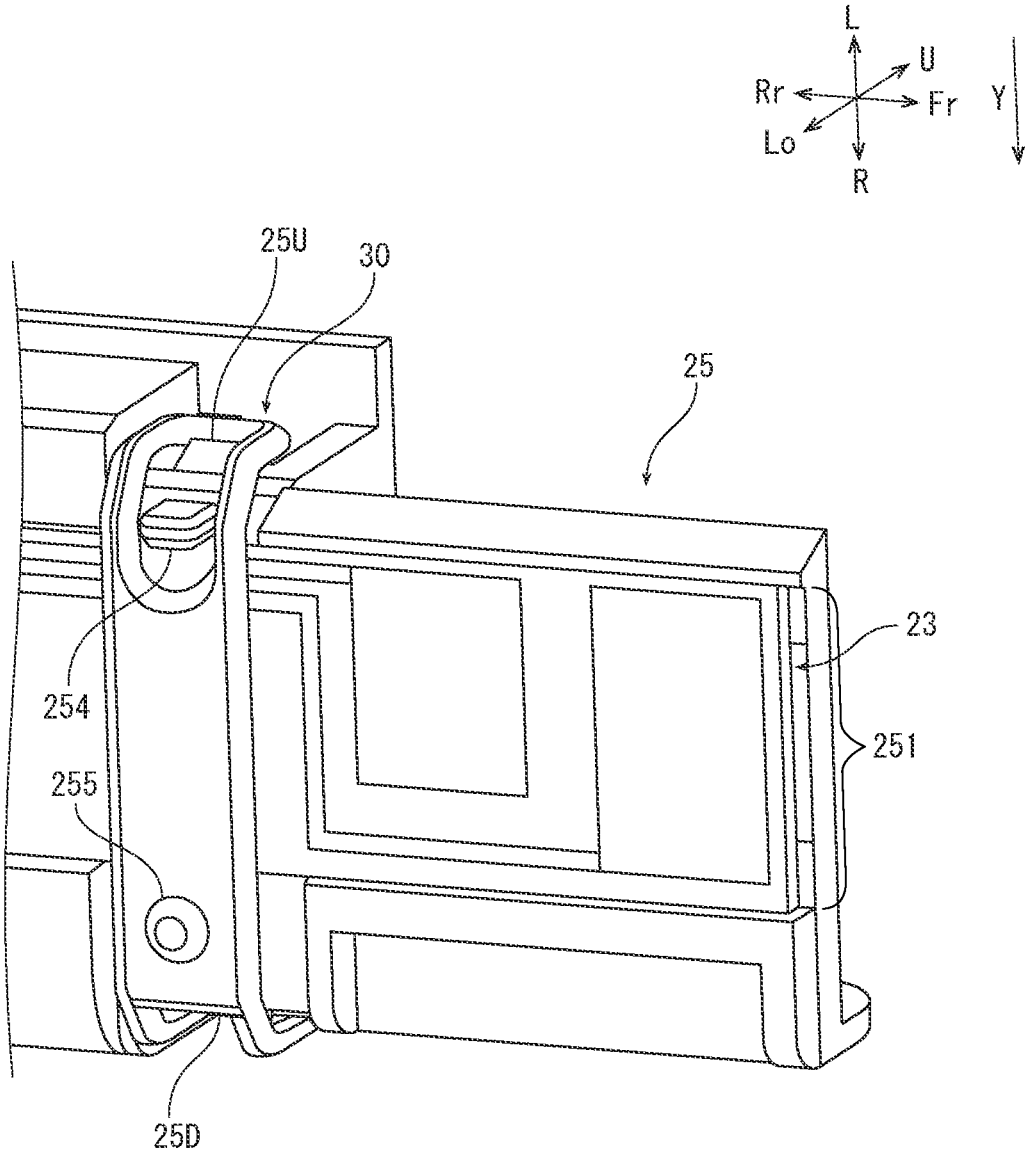
FIG. 7 is a side view showing the front end portion of the heater holder to which a flat heater and a mounting member are attached, according to the embodiment of the present disclosure.
Figure 8:
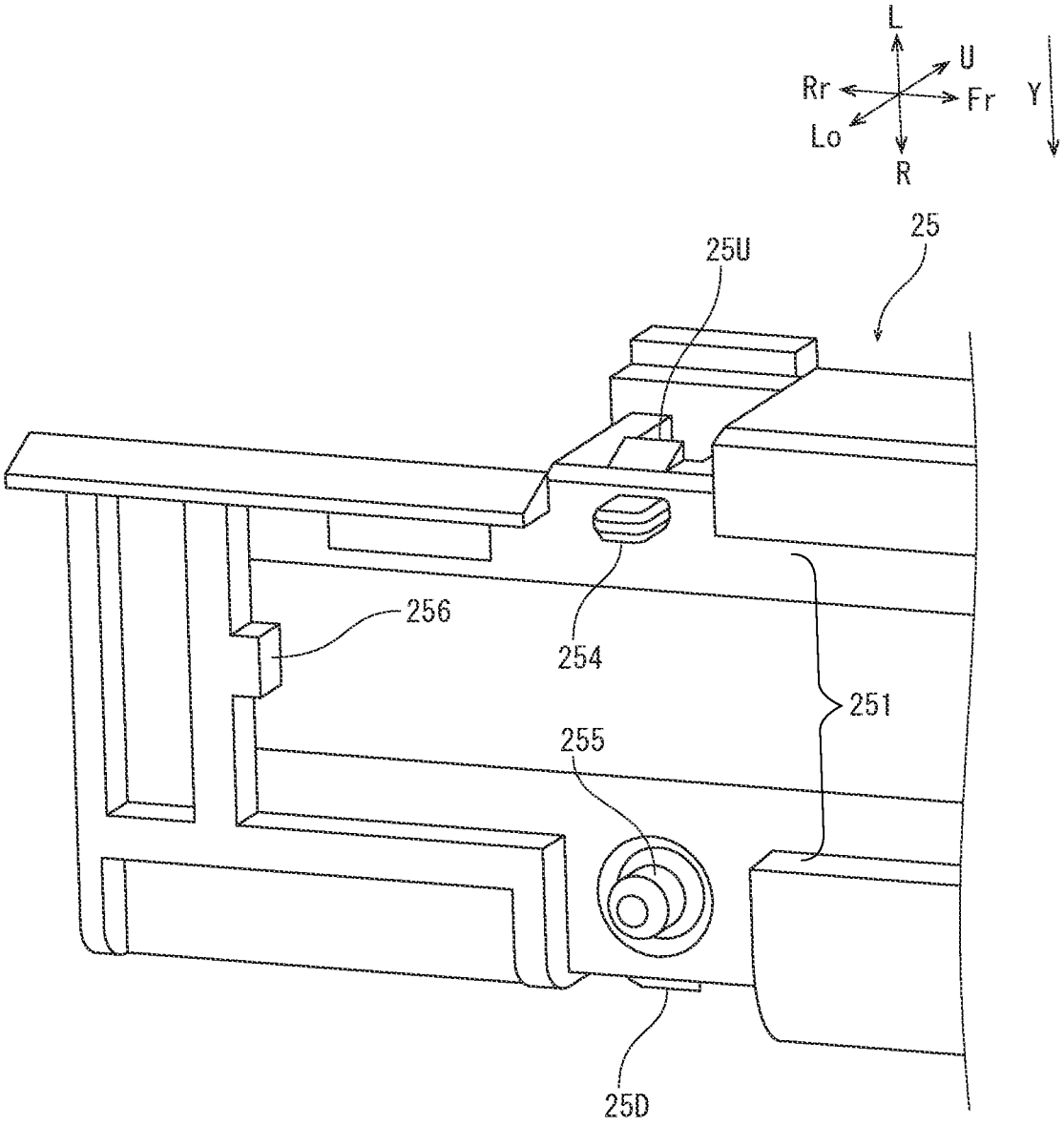
FIG. 8 is a perspective view showing a rear end portion of the heater holder according to the embodiment of the present disclosure.
Figure 9:
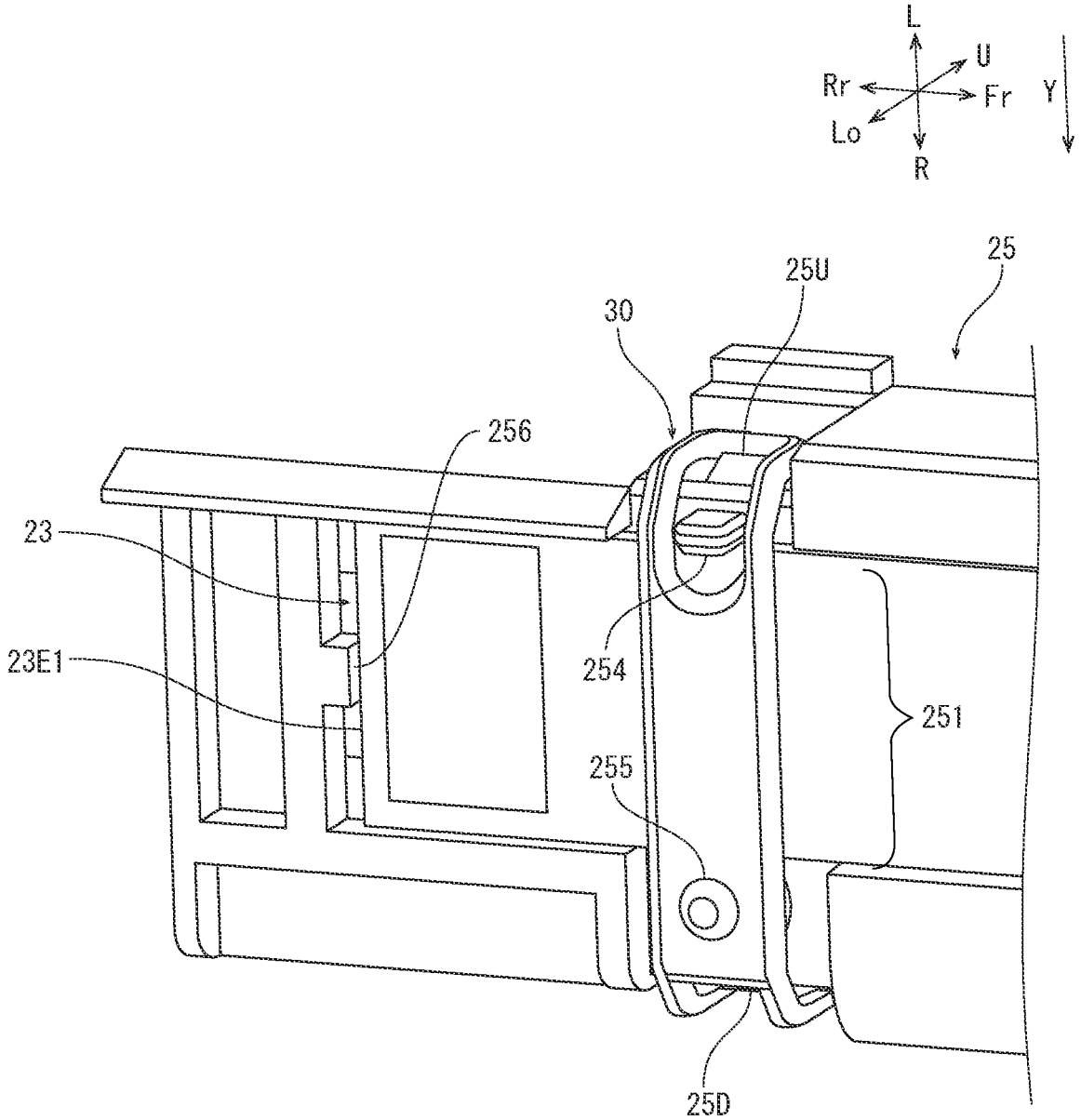
FIG. 9 is a side view showing the rear end portion of the heater holder to which the flat heater and the mounting member are attached, according to the embodiment of the present disclosure.
Figure 10:
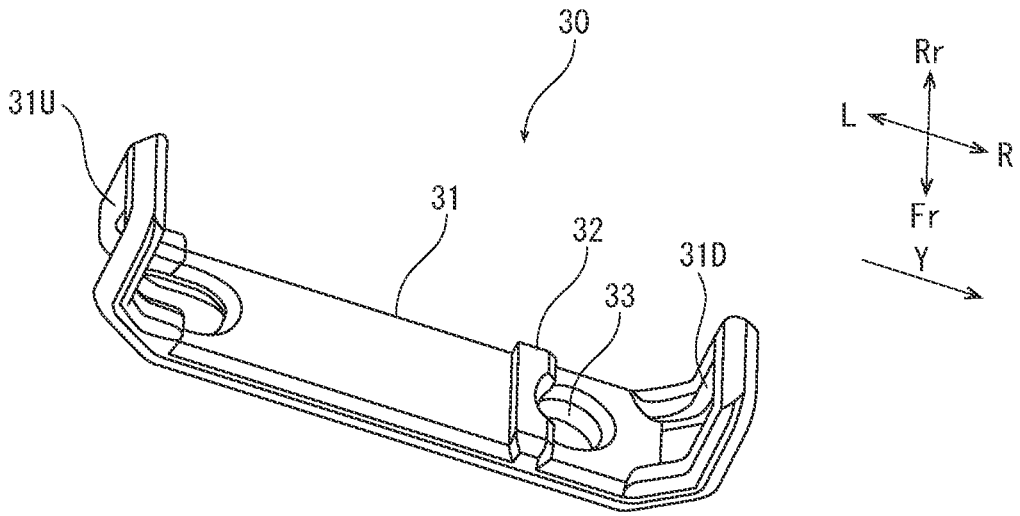
FIG. 10 is a perspective view showing the mounting member according to the embodiment of the present disclosure.
Figure 11:
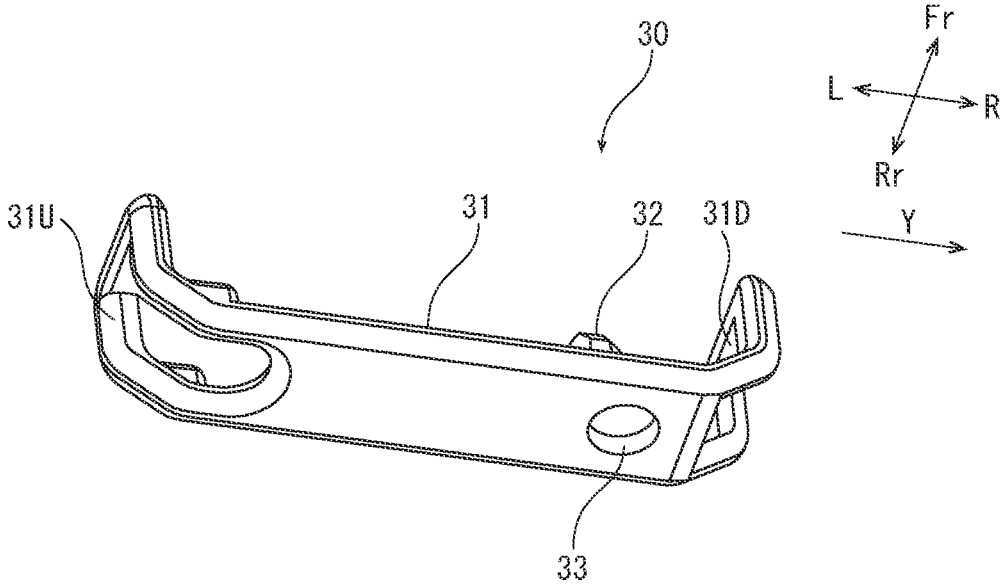
FIG. 11 is a perspective view showing the fixing member according to the embodiment of the present disclosure.
Figure 12:
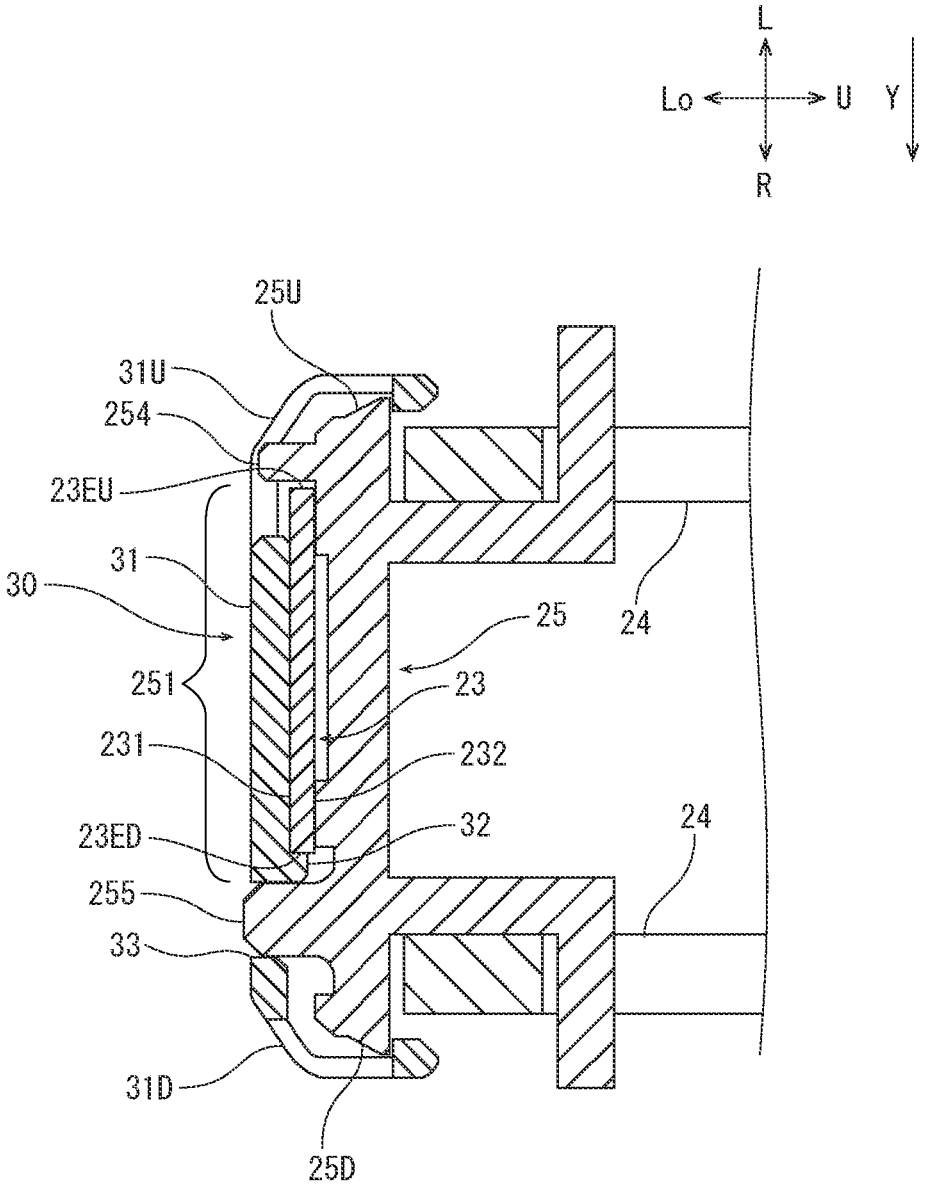
FIG. 12 is a sectional view showing the heater holder to which the flat heater and the mounting member are attached, according to the embodiment of the present disclosure.

Next, a configuration for preventing the deviation of the flat heater 23 in the conveying direction Y will be described. FIG. 6 is a perspective view showing the front end portion of the heater holder 25. FIG. 7 is a perspective view showing the front end portion of the heater holder 25 to which the flat heater 23 and a mounting member 30 are attached. FIG. 8 is a perspective view showing the rear end portion of the heater holder 25. FIG. 9 is a perspective view showing the rear end portion of the heater holder 25 to which the flat heater 23 and the mounting member 30 are attached. FIG. 10 and FIG. 11 are perspective views showing the mounting member 30. FIG. 12 is a sectional view showing the heater holder 25 to which the flat heater 23 and the mounting member 30 are attached.

The fixing device 7 includes the cylindrical fixing belt 21; the pressing roller 27 which holds a sheet between the pressing roller 27 and the fixing belt 21 and conveys the sheet; the flat heater 23 having a length in a width direction crossing the conveying direction Y of the sheet S longer than a length of the fixing belt 21, and having a first surface 231 coming into contact with the inner circumferential surface of the fixing belt 21 and the second surface 232 opposite to the first surface 231; the heater holder 25 which comes into contact with the second surface 232 of the flat heater 23 and has a length in the width direction longer than a length of the fixing belt 21; and the pair of mounting members 30 which come into contact with both end portions of the first surface 231 of the flat heater 23 in the width direction, and is mounted to the heater holder 25 such that the flat heater 23 is held between the mounting members 30 and the heater holder 25. The pair of mounting members 30 is provided with a downstream side end surface contact part 32 which comes into contact with a downstream side end surface 23ED of the flat heater 23 in the conveying direction Y.

The heater holder 25 is provided with wedge-shaped upstream side protrusions 25U and downstream side protrusions 25D on the front and rear sides of the belt holding part 26H of the end belt holder 26 (see FIG. 6 and FIG. 8). The upstream side protrusions 25U protrude from one side surface (the left side surface) on the upstream side of the heater holder 25 in the conveying direction Y, and the downstream side protrusions 25D protrude from the other side surface (the right side surface) on the downstream side of the heater holder 25 in the conveying direction Y. On the upstream side of the first recess part 251 on the lower surface of the heater holder 25 in the conveying direction Y, an upstream side end surface facing part 254 facing the upstream side end surface (the upstream end surface 23EU, see FIG. 12) of the flat heater 23 in the conveying direction Y. Further, on the downstream side of the first recess part 251 on the lower surface of the heater holder 25 in the conveying direction Y, a projection 255 is provided.

The mounting member 30 (see FIG. 7 and FIG. 9 to FIG. 12) is a plate-like member made of resin, metal, and the like. The mounting member 30 has a main body part 31 whose longitudinal direction is along the conveying direction Y, and both the longitudinal end portions of the main body part 31 are bent upward. In the upstream end portion of the mounting member 30 in the conveying direction Y, an upstream side mounting part 31U mounted on the upstream side protrusion 25U of the heater holder 25 is provided. The upstream side mounting part 31U is an opening into which the upstream side protrusion 25U and the upstream side end surface facing part 254 are inserted. In the downstream end portion of the mounting member 30 in the conveying direction Y, a downstream side mounting part 31D mounted on the downstream side protrusion 25D of the heater holder 25 is provided. The downstream side mounting part 31D is an opening into which the downstream side protrusion 25D is inserted. The mounting member 30 is provided with a hole 33 into which the projection 255 is fitted.

On the upper surface of the main body part 31 of the mounting member 30, a downstream side end surface contact part 32 contacting with the downstream side end surface 23ED of the flat heater 23 is provided. The downstream side end surface contact part 32 has a convex shape whose longitudinal direction is along the front-and-rear direction.

The flat heater 23 and the mounting member 30 are mounted as follows. First, the flat heater 23 is inserted into the first recess part 251 of the heater holder 25. At this time, the second surface 232 of the flat heater 23 comes into contact with the first recess part 251. The upstream side end surface 23EU of the flat heater 23 faces the upstream side end surface facing part 254.

Next, the mounting member 30 is mounted. Specifically, when both the end portions of the mounting member 30 in the conveying direction Y are brought into contact with the upstream side protrusion 25U and the downstream side protrusion 25D of the heater holder 25 and the mounting member 30 is pushed in, both the end portions of the mounting member 30 in the conveying direction Y are pushed and widened. The deformation of the mounting member 30 at this time is elastic deformation, and the deformation of the mounting member 30 is restored by fitting the upstream side protrusion 25U into the upstream side mounting part 31U and fitting the downstream side protrusion 25D into the downstream side mounting part 31D. That is, the mounting member 30 is mounted to the heater holder 25 by a snap fit coupling method.

When the mounting member 30 is mounted on the heater holder 25, the upper surface of the main body part 31 of the mounting member 30 is brought into contact with the first surface 231 of the flat heater 23, and the flat heater 23 is held between the first recess part 251 of the heater holder 25 and the mounting member 30. Thus, the flat heater 23 is fixedly mounted in the upper-and-lower direction (the direction of pressuring by the pressing roller 27).

When the fixing belt 21 is driven, since the fixing belt 21 slides in the conveying direction Y with respect to the flat heater 23, the flat heater 23 receives frictional force in the conveying direction Y, but since the downstream side end surface 23ED of the flat heater 23 is in contact with the downstream side end surface contact part 32 of the mounting member 30, the deviation of the flat heater 23 in the conveying direction Y is not generated.

The fixing device 7 according to the present embodiment described above includes the cylindrical fixing belt 21; the pressing roller 27 which holds a sheet between the pressing roller 27 and the fixing belt 21 and conveys the sheet; the flat heater 23 having a length in a width direction crossing the conveying direction Y of the sheet S longer than a length of the fixing belt 21, and having a first surface 231 coming into contact with the inner circumferential surface of the fixing belt 21 and the second surface 232 opposite to the first surface 231; the heater holder 25 which comes into contact with the second surface 232 of the flat heater 23 and has a length in the width direction longer than a length of the fixing belt 21; and the pair of mounting members 30 which come into contact with both end portions of the first surface 231 of the flat heater 23 in the width direction, and is mounted to the heater holder 25 such that the flat heater 23 is held between the mounting members 30 and the heater holder 25. The pair of mounting members 30 is provided with a downstream side end surface contact part 32 which comes into contact with a downstream side end surface 23ED of the flat heater 23 in the conveying direction Y. According to this constitution, it becomes possible to prevent the deviation of flat heater 23 in the conveying direction Y without bonding the flat heater 23.

Further, according to the fixing device 7 according to the present embodiment, so that the positioning of the flat heater 23 in the conveying direction Y during the assembly can be easily performed.

The above embodiment may be modified as follows.

The above embodiment shows an example where the heater holder 25 is provided with the upstream side end surface facing part 254, but instead of the upstream side end surface facing part 254, the mounting member 30 may be provided with an upstream side end surface facing part (not shown) facing the upstream side end surface 23EU of the flat heater 23. By this configuration, it becomes possible to perform the positioning of the flat heater 23 in the conveying direction Y during the assembly.

In addition to the configuration of the above-described embodiment, the heater holder 25 may include a first end surface facing part 256 facing the first end surface 23E1 of the flat heater 23 in the width direction, and the mounting member 30 on the side of the second end surface 23E2 of the flat heater 23 in the width direction of the flat heater 23 among the pair of mounting members 30 may include a second end surface facing part 34 facing the second end surface 23E2. As an example, FIG. 8 and FIG. 9 show a state in which the heater holder 25 is provided with the first end surface facing part 256 facing the rear end face (the first end surface 23E1) of the flat heater 23.

Figure 13:
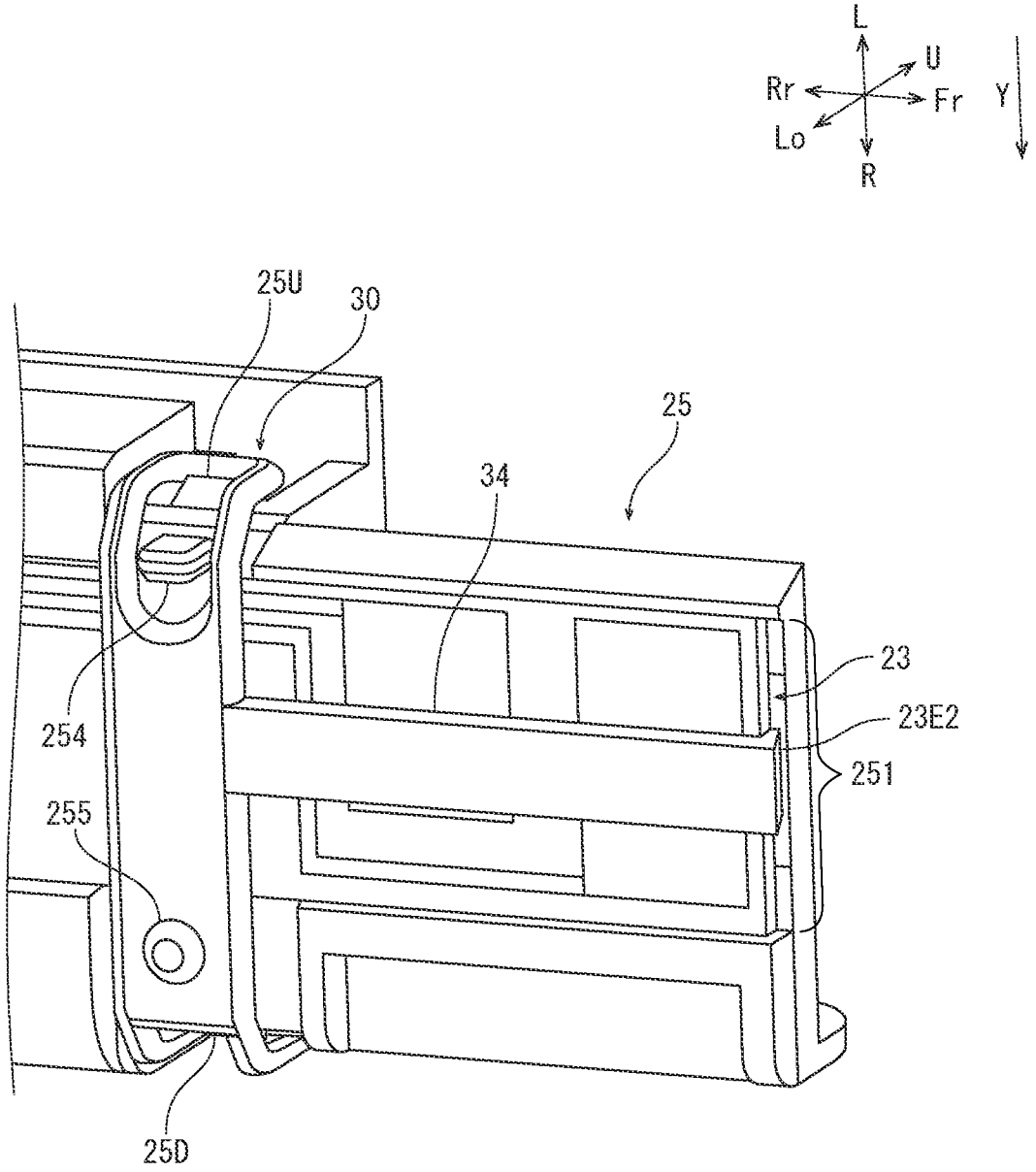
FIG. 13 is a view showing a second end surface facing part according to a modified example of the embodiment of the present disclosure.

On the other hand, FIG. 13 is a view showing the second end surface facing part 34. In this example, the front mounting member 30 is provided with the second end surface facing part 34. The second end surface facing part 34 is provided from slightly above the center of the mounting member 30 in the upper-and-lower direction toward the front side, and the distal end portion formed in a hook shape faces the front end surface (the second end surface 23E2) of the flat heater 23. According to this configuration, it becomes possible to perform positioning of the flat heater 23 in the width direction easily during the assembly.

Instead of the first end surface facing part 256, the mounting member 30 on the side of the first end surface 23E1 may be provided with a first end surface facing part (not shown) facing the first end surface 23E1. According to this configuration, it becomes possible to perform positioning of the flat heater 23 in the width direction easily during the assembly.

Figure 14:
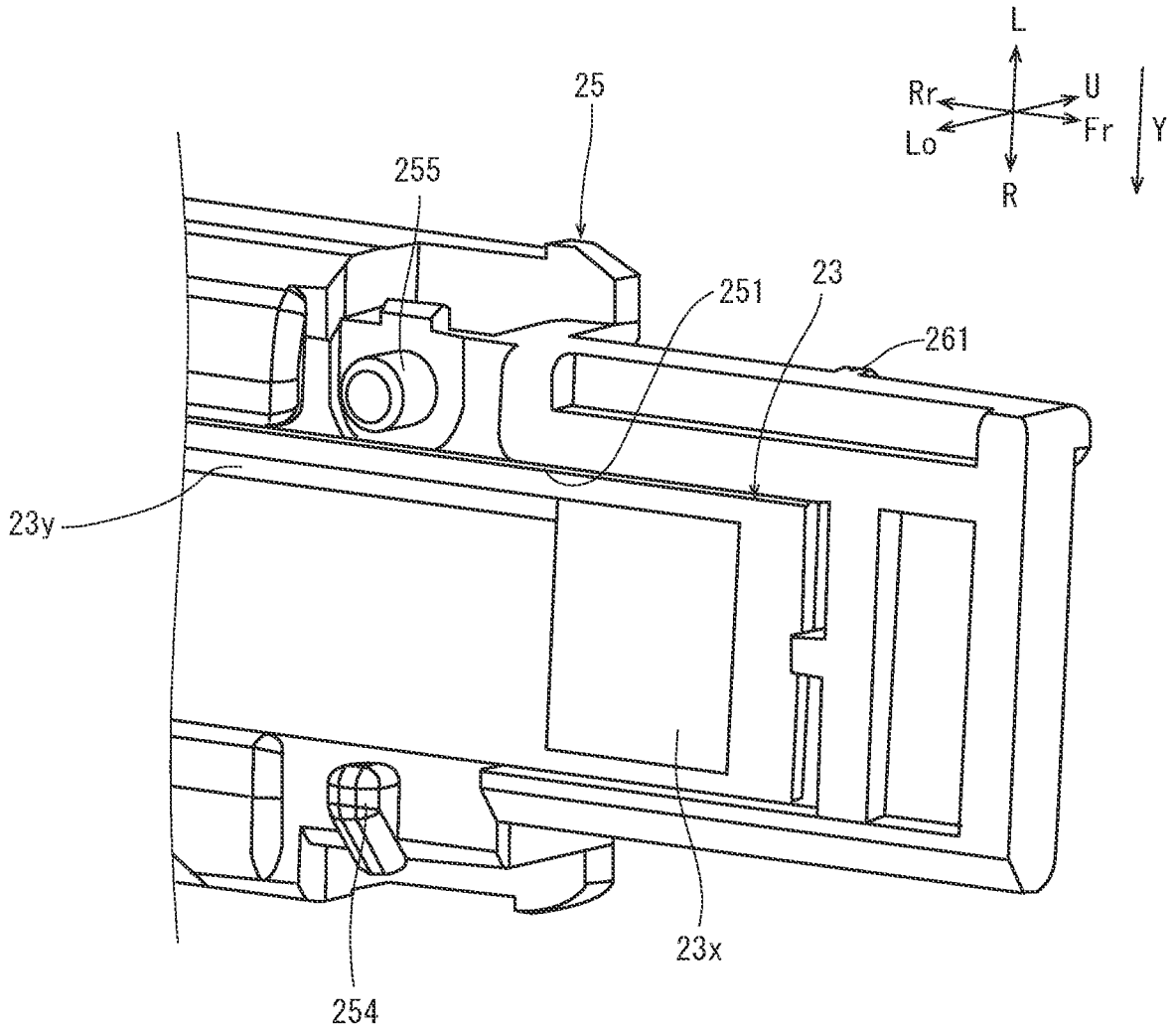
FIG. 14 is a perspective view showing the front end portion of the heater holder to which the flat heater is attached, according to another modified example of the embodiment of the present disclosure.
Figure 15:
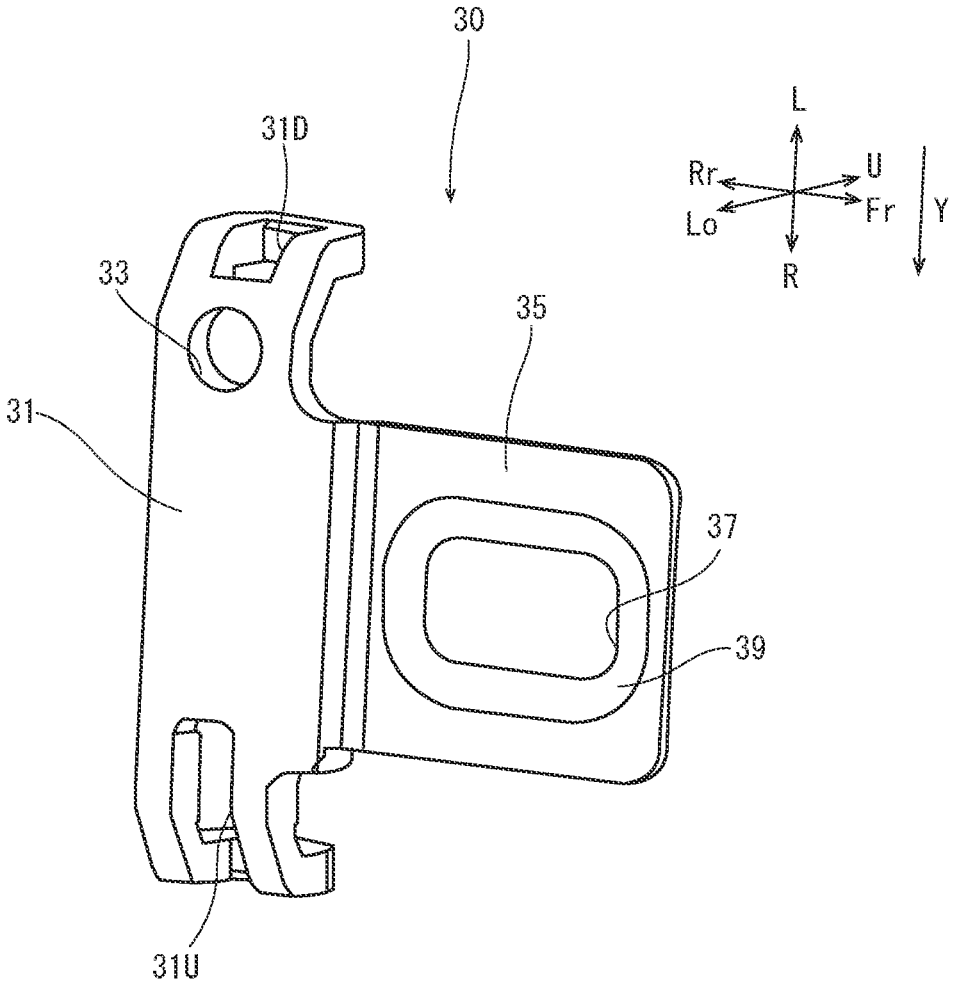
FIG. 15 is a perspective view showing the mounting member according to another modified example of the embodiment of the present disclosure.
Figure 16:
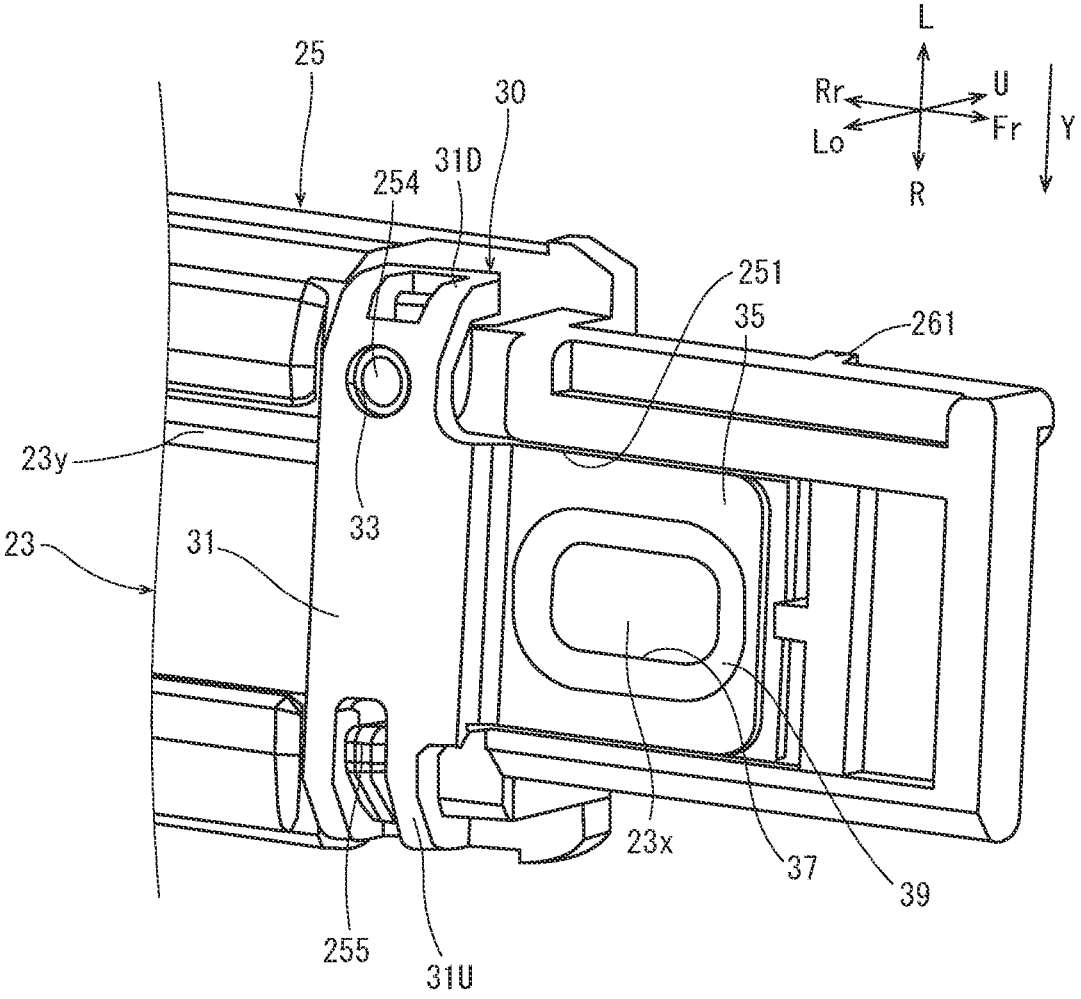
FIG. 16 is a perspective view showing the front end portion of the heater holder to which the flat heater is attached by the mounting member, in another modified example of the embodiment of the present disclosure.

Next, the flat heater 23 having an electrode portion 23*x* will be described with reference to FIG. 14 to FIG. 16. FIG. 14 is a perspective view showing the front end portion of the heater holder 25 on which the flat heater 23 is supported, FIG. 15 is a perspective view showing the mounting member 30, and FIG. 16 is a perspective view showing the front end portion of the heater holder 25 on which the flat heater 23 is mounted by the mounting member 30.

As shown in FIG. 14, a rectangular electrode portion 23*x* is provided in one end portion (the front end portion) of the first surface of the flat heater 23 in the width direction. The electrode portion 23*x* is electrically connected to a power source (not shown) provided in the image forming apparatus 1 via a connector 50, which will be described later. A power supply portion 23*y* in which a power supply line connecting each heating part of the flat heater 23 and the electrode portion 23*x* is wired extends from the electrode portion 23*x*. The current supplied from the power supply to the electrode portion 23*x* via the connector 50 is supplied to each heating part via the power supply portion 23*y*. When the flat heater 23 is supported in the first recess part 251 of the heater holder 25, the electrode portion 23*x* is arranged outside (the front side) of the upstream side end surface facing part 254 and the projection 255 of the heater holder 25. A part of the heater holder 25 outside (the front side) of the upstream side end surface facing part 254 and the projection 255 is referred to as a front end portion of the heater holder 25.

A guide projection 261 is formed in the front end portion of the heater holder 25. The guide projection 261 is formed along the conveying direction Y on the surface (hereinafter referred to as the bottom surface) opposite to the surface (hereafter, referred to as the upper surface) on which the first recess part 251 is provided.

The mounting member 30 will be described with reference to FIG. 15. The mounting member 30 has the main body part 31 and an electrode protection part 35 provided integrally with the main body part 31. The main body part 31 has the same configuration as that of the above-described embodiment. The electrode protection part 35 is provided along the front side edge of the main body part 31 integrally with the main body part 31. The electrode protection part 35 is formed in a rectangular shape having a dimension corresponding to the electrode portion 23*x* of the flat heater 23 and a thickness capable of fitting into the first recess part 251 of the heater holder 25. An approximately rectangular opening 37 is formed in the electrode protection part 35 to expose a part of the electrode portion 23*x* of the flat heater 23. An inclined portion 39 inclined toward the opening 37 is provided around the opening 37. That is, the inclined portion 39 is formed so that its thickness gradually decreases toward the opening 37.

As shown in FIG. 16, when the flat heater 23 is supported by the first recess part 251 of the heater holder 25 and the flat heater 23 is mounted on the heater holder 25 by the main body part 31 of the mounting member 30, the electrode protection part 35 of the mounting member 30 is fitted into the first recess part 251 and comes into contact with the first surface of the flat heater 23. Thus, the electrode portion 23*x* is covered with the electrode protection part 35, and a part of the electrode portion 23*x* is exposed from the opening 37.

Figure 17:
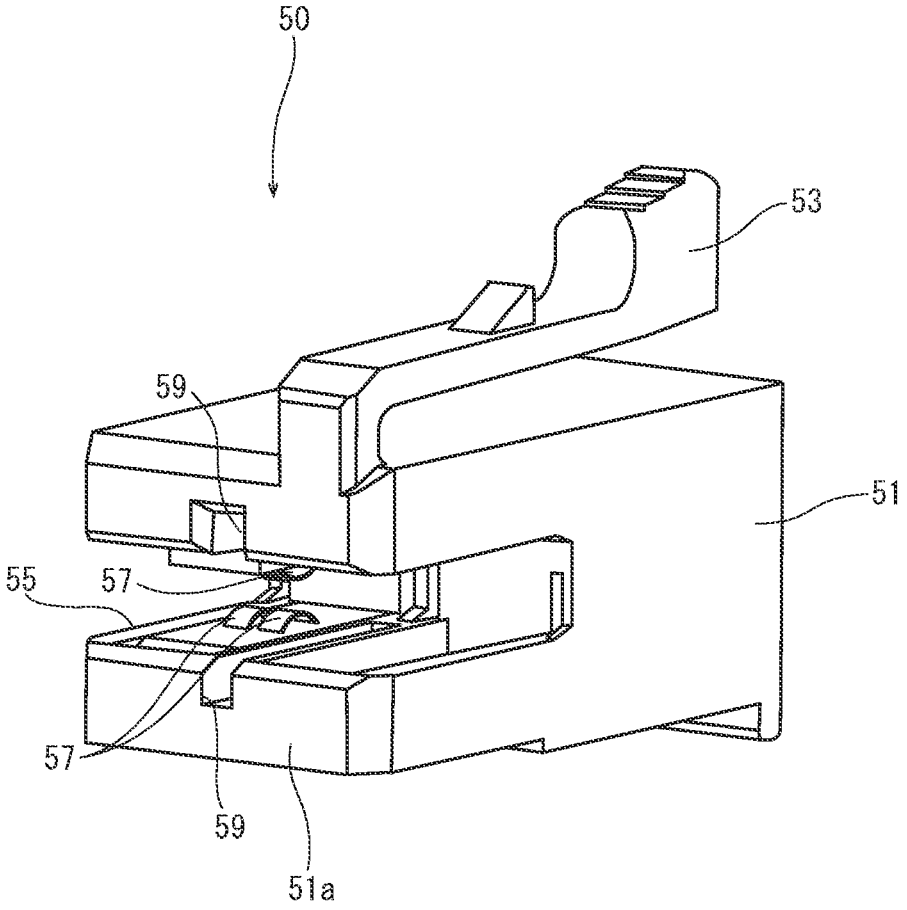
FIG. 17 is a perspective view showing a connecter which is connected to the flat heater, in another modified example of the embodiment of the present disclosure.

Next, the connector 50 will be described with reference to FIG. 17. FIG. 17 is a perspective view showing the connector 50.

The connector 50 has a rectangular parallelepiped body part 51 and a lever part 53 elastically deformably connected to the body part 51. A recess 55 is formed in the body part 51 from one end surface 51*a* along the longitudinal direction of the body part 51. Two terminals 57 are respectively supported on opposite side surfaces of the recess 55. Each terminal 57 is an arc-shaped leaf spring member along the longitudinal direction, and can be elastically deformed into a flat shape by being pushed in. Each terminal 57 is connected to the power source via wiring (not shown). Further, grooves 59 are formed in the opposite side surfaces of the recess 55 along the longitudinal direction from the end surface 51*a*.

Figure 18A:
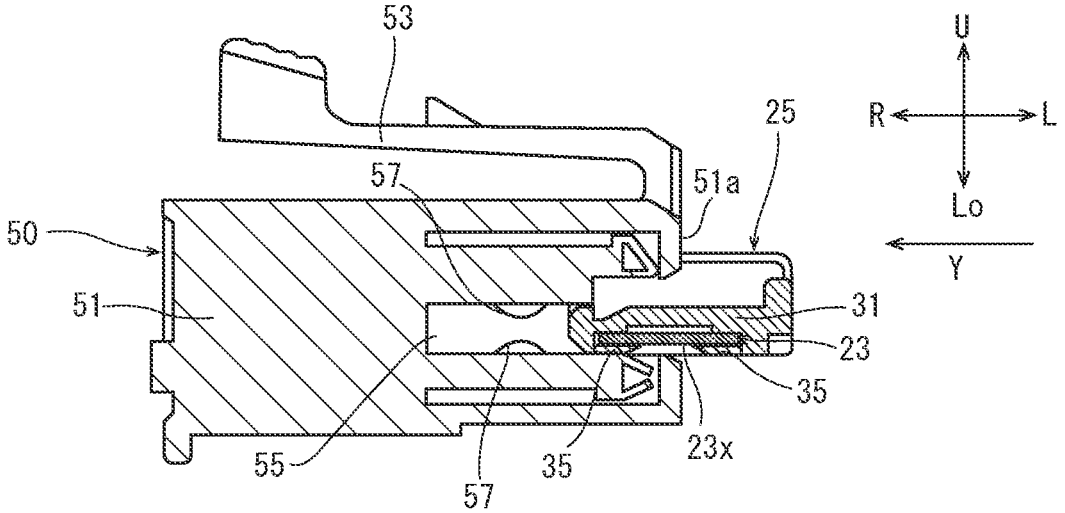
FIG. 18A is a sectional view showing the flat heater, the heater holder and the connecter in the middle of a process for connecting the connecter to the flat heater attached to the heater holder, in another modified example of the embodiment of the present disclosure.
Figure 18B:
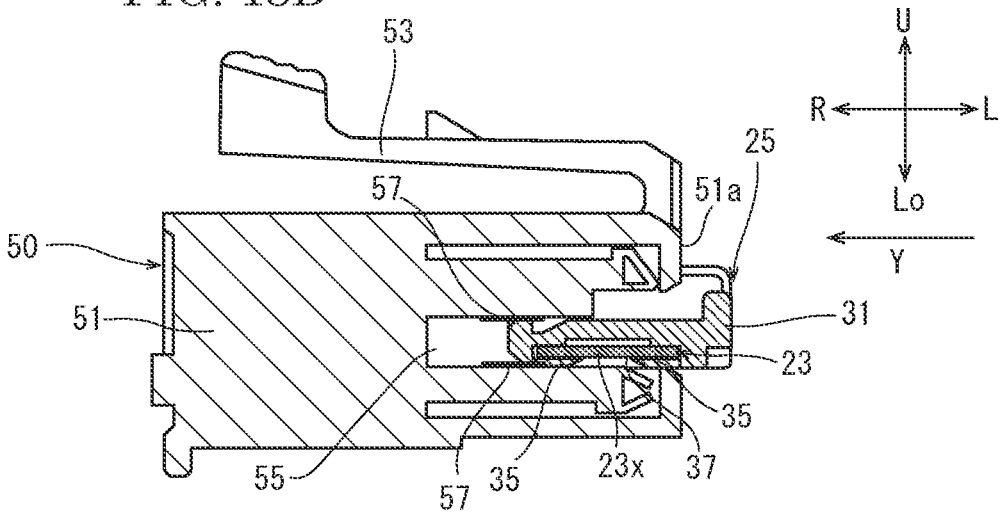
FIG. 18B is a sectional view showing the flat heater, the heater holder and the connecter in the middle of a process for connecting the connecter to the flat heater attached to the heater holder, in another modified example of the embodiment of the present disclosure.
Figure 18C:
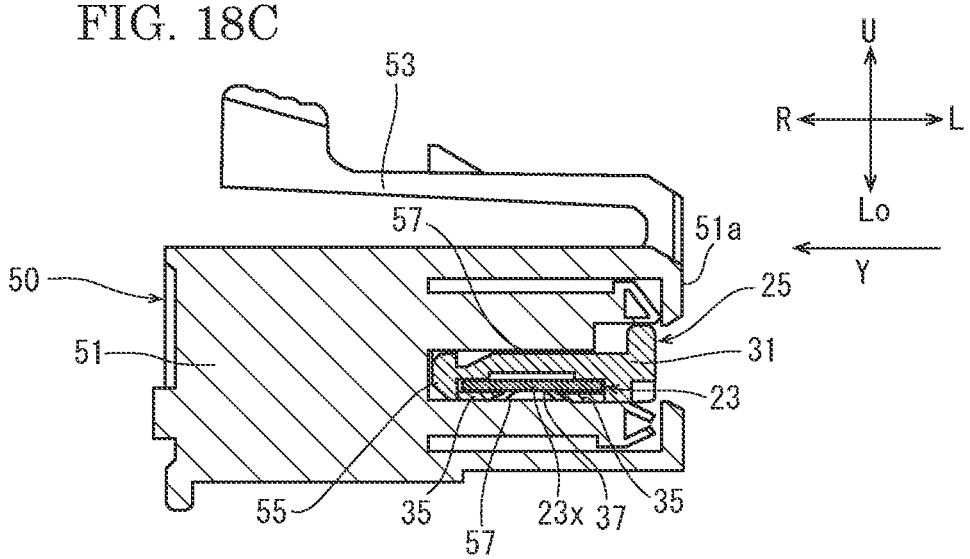
FIG. 18C is a sectional view showing the flat heater, the heater holder and the connecter in the middle of a process for connecting the connecter to the flat heater attached to the heater holder, in another modified example of the embodiment of the present disclosure.

With reference to FIG. 18A to FIG. 18C, a process of connecting the connector 50 to the flat heater 23 mounted on the heater holder 25 will be described. FIG. 18A to FIG. 18C are sectional views showing the flat heater 23, the heater holder 25, and the connector 50 in a middle of the process of connecting connector 50 to the flat heater 23 mounted on the heater holder 25.

First, the one end surface 51*a* (the opening of the recess 55) of the body part 51 of the connector 50 faces the front end portion of the heater holder 25 from the downstream side in the conveying direction Y. Then, the guide projection 261 (see FIG. 16) formed in the front end portion of the heater holder 25 is engaged with the groove 59 (see FIG. 17) formed on one side surface of the recess 55 of the connector 50, and the connector 50 is moved to the upstream side in the conveying direction Y. The connector 50 is guided along the guide projection 261 toward the upstream side in the conveying direction Y, and the front end portion of the heater holder 25 begins to be inserted into the recess 55 of the connector 50, as shown in FIG. 18A.

As the connector 50 is further moved, as shown in FIG. 18B, the terminals 57 supported on both the oppose side surfaces of the recess 55 are pushed in by the front end portion of the heater holder 25, and elastically deformed into the flat shapes. Specifically, the terminal 57 supported on the upper side surface of the recess 55 is pushed in by the upper surface of the front end portion of the heater holder 25, and the terminal 57 supported on the lower side surface of the recess 55 is pushed in by the lower surface of the front end portion of the heater holder 25 and the electrode protection part 35 of the mounting member 30.

When the connector 50 is further moved, the terminal 57 of the connector 50 reaches the inclined portion 39 of the electrode protection part 35 on the lower surface of the front end portion of the heater holder 25. Since the inclined portion 39 is formed so as to become thinner toward the opening 37, the terminals 57 gradually begins to be elastically returned. As shown in FIG. 18C, when the front end portion of the heater holder 25 is completely inserted into the recess 55 of the connector 50, the terminals 57 of the connector 50 reaches the electrode portion 23*x* of the flat heater 23 from the opening 37 of the electrode protection part 35, and elastically returns to contact with the electrode portion 23*x* at a predetermined pressure.

As described above, when the connector 50 is mounted on the heater holder 25, the terminals 57 of the connector 50 move to the electrode portion 23*x* along the electrode protection part 35 of the mounting member 30, so that the electrode portion 23*x* does not contact the terminal 57 during the movement. Since the electrode portion 23*x* is not scraped by the terminal 57 when the connector 50 is attached and detached, wear of the electrode portion 23*x* is suppressed, and the current supplied to the electrode portion 23*x* can be reliably supplied to the heating part of the flat heater 23.

The mounting direction of the connector 50 is not limited to the conveying direction Y, but may be a direction crossing the conveying direction Y. Even in this case, since the periphery of the electrode portion 23*x* is covered with the electrode protection part 35, the electrode portion 23*x* does not come into contact with the terminals 57 when the connector 50 is mounted.

The invention claimed is:

1. A fixing device comprising:

a cylindrical fixing belt;

a pressing roller which holds a sheet between the pressing roller and the fixing belt and conveys the sheet;

a flat heater having a length in a width direction crossing a conveying direction of the sheet longer than a length of the fixing belt, and having a first surface coming into contact with an inner circumferential surface of the fixing belt and a second surface opposite to the first surface;

a heater holder which comes into contact with the second surface of the flat heater and has a length in the width direction longer than a length of the fixing belt; and a pair of mounting members which come into contact with both end portions of the first surface of the flat heater in the width direction, and is mounted to the heater holder such that the flat heater is held between the mounting members and the heater holder, wherein the pair of mounting members is provided with a downstream side end surface contact part which comes into contact with a downstream side end surface of the flat heater in the conveying direction.

2. The fixing device according to claim 1, wherein the pair of mounting members is attached to the heater holder by a snap fit coupling method on an upstream side and a downstream side of the flat heater in the conveying direction.

3. The fixing device according to claim 1, wherein the heater holder is provided with an upstream side end surface facing part facing an upstream side end surface of the flat heater in the conveying direction.

4. The fixing device according to claim 3, wherein the upstream side end surface facing part is inserted into an opening of the mounting member.

5. The fixing device according to claim 1, wherein the pair of mounting members is provided with an upstream side end surface facing part facing an upstream side end surface of the flat heater in the conveying direction.

6. The fixing device according to claim 1, wherein the heater holder is provided with a first end surface facing part facing a first end surface of the flat heater in the width direction, the mounting member on a second end surface side of the flat heater in the width direction among the pair of mounting members includes a second end surface facing part facing the second end surface.

7. The fixing device according to claim 1, wherein the mounting member on the first end surface side of the flat heater in the width direction among the pair of mounting members is provided with a first end surface facing part facing the first end surface, and the mounting member on the second end face side of the flat heater in the width direction among the pair of mounting members is provided with a second end surface facing part facing the second end surface.

8. The fixing device according to claim 1, further comprising:

a connector which is mounted on the heater holder along a predetermined mounting direction and is electrically conductive to an electrode portion of the flat heater, and one of the pair of mounting members is provided with an electrode protection part covering the flat heater on an upstream side of the electrode portion in the mounting direction of the connector.

9. The fixing device according to claim 8, wherein the electrode protection part has an opening for exposing the electrode portion and an inclined part provided around the opening so as to be inclined toward the opening.

10. An image forming apparatus comprising:

an image forming device which forms a toner image on the sheet, and the fixing device according to claim 1, which fixes the toner image to the sheet.

* * * * *